US008312568B2

(12) United States Patent
Marois et al.

(10) Patent No.: US 8,312,568 B2
(45) Date of Patent: Nov. 20, 2012

(54) THREE-IN-TWO POCKET SYSTEM

(75) Inventors: Caroline Marois, Lafayette, CO (US); Sue McKinney, Broomfield, CO (US)

(73) Assignee: Dashamerica, Inc., Louisville, CO (US)

( * ) Notice: Subject to any disclaimer, the term of this patent is extended or adjusted under 35 U.S.C. 154(b) by 440 days.

(21) Appl. No.: 12/355,638

(22) Filed: Jan. 16, 2009

(65) Prior Publication Data

US 2010/0180361 A1 Jul. 22, 2010

(51) Int. Cl.
*A41D 27/20* (2006.01)
*A41B 1/00* (2006.01)

(52) U.S. Cl. ..... 2/252; 2/253; 2/115

(58) Field of Classification Search ..... 2/49.2, 2/77, 79, 80, 75, 94, 102, 106, 115, 227, 2/244, 245, 247, 248, 249, 250, 251, 252, 2/253, 254, 86
See application file for complete search history.

(56) References Cited

U.S. PATENT DOCUMENTS

| | | | | | |
|---|---|---|---|---|---|
| 352,297 | A | * | 11/1886 | Cohlman | 2/227 |
| 625,423 | A | * | 5/1899 | Scriven | 2/401 |
| 1,497,460 | A | * | 6/1924 | Nilssen | 2/94 |
| 1,787,706 | A | * | 1/1931 | Stember | 206/466 |
| 2,038,331 | A | * | 4/1936 | Woolf | 2/253 |
| 2,097,975 | A | * | 11/1937 | Habegger | 2/247 |
| 2,165,348 | A | * | 7/1939 | Daiber | 2/94 |
| 2,263,538 | A | * | 11/1941 | Freirich | 2/51 |
| 2,508,190 | A | * | 5/1950 | Previdi | 2/253 |
| 2,521,410 | A | * | 9/1950 | Rosen | 2/227 |
| 2,607,040 | A | * | 8/1952 | Zaleski | 2/51 |
| 2,617,103 | A | * | 11/1952 | Westgarth | 2/48 |
| 2,697,465 | A | * | 12/1954 | Johnson | 383/4 |
| 2,846,685 | A | * | 8/1958 | Ehrich | 2/51 |
| 3,533,459 | A | * | 10/1970 | Ody | 150/113 |
| D257,596 | S | * | 12/1980 | Rosenbloom, III | D2/864 |
| 4,461,030 | A | | 7/1984 | Knudsen | |
| 4,535,878 | A | * | 8/1985 | Grahl | 190/1 |
| 4,637,075 | A | * | 1/1987 | Ingrisano et al. | 2/94 |
| 4,791,681 | A | * | 12/1988 | Dean | 2/106 |
| 5,207,254 | A | | 5/1993 | Fromm | |
| 5,244,025 | A | | 9/1993 | Wewers | |
| 5,244,136 | A | * | 9/1993 | Collaso | 224/673 |
| 5,509,147 | A | * | 4/1996 | Busquets | 2/253 |
| 5,517,696 | A | * | 5/1996 | Krugler | 2/250 |

(Continued)

OTHER PUBLICATIONS

U.S. Appl. No. 29/330,601, filed Jan. 9, 2009.

(Continued)

*Primary Examiner* — Alissa L Hoey
(74) *Attorney, Agent, or Firm* — Sheridan Ross, P.C.

(57) ABSTRACT

A pocket system for an athletic garment according to embodiments of the present invention includes a center pocket and first and second pockets each having an outer, inner, top, and bottom edge. The top edges are open, while the inner, outer, and bottom edges are closed. A vertical centerline of the garment substantially aligns with a user's spine, and the first pocket is located on the athletic garment on one side of the vertical centerline, while the second pocket is located on the garment on the other side of the vertical centerline. The first and second pockets are in a substantially symmetrical configuration about the vertical centerline, and the center pocket is substantially centered on the vertical centerline. The first and second pockets at least partially overlap the center pocket, and the pocket system looks from the back view like two pockets, according to such embodiments of the present invention.

20 Claims, 13 Drawing Sheets

U.S. PATENT DOCUMENTS

| | | | | |
|---|---|---|---|---|
| 5,652,961 | A * | 8/1997 | Knight-Yurt | 2/114 |
| 5,720,050 | A * | 2/1998 | Gioli | 2/247 |
| 5,724,679 | A * | 3/1998 | Hans | 2/238 |
| 5,852,828 | A | 12/1998 | Foster | |
| 5,870,777 | A * | 2/1999 | Hans | 2/238 |
| 5,938,337 | A | 8/1999 | Provan et al. | |
| 5,987,644 | A | 11/1999 | Mengato | |
| 6,049,914 | A * | 4/2000 | Heilman | 2/247 |
| 6,219,846 | B1 * | 4/2001 | Toole | 2/49.2 |
| 6,298,485 | B1 | 10/2001 | Heller | |
| 6,363,538 | B1 * | 4/2002 | Davis | 2/247 |
| D461,945 | S * | 8/2002 | Byrd | D2/864 |
| 6,760,922 | B1 | 7/2004 | Morales | |
| 6,823,909 | B1 * | 11/2004 | Marsteller | 150/113 |
| 6,993,940 | B2 * | 2/2006 | Rabinowicz et al. | 66/176 |
| 7,058,987 | B2 * | 6/2006 | Salazar | 2/247 |
| 7,219,373 | B2 * | 5/2007 | McNamara | 2/48 |
| 7,364,491 | B2 * | 4/2008 | Updyke | 450/89 |
| 7,631,368 | B1 * | 12/2009 | Samson | 2/247 |
| 7,636,949 | B1 * | 12/2009 | Shooshan | 2/48 |
| D612,583 | S * | 3/2010 | Marois et al. | D2/857 |
| 7,681,255 | B2 * | 3/2010 | Morales et al. | 2/247 |
| D623,830 | S * | 9/2010 | Marois et al. | D2/857 |
| 7,886,368 | B2 * | 2/2011 | Hood | 2/102 |
| 7,908,675 | B2 * | 3/2011 | Robinson | 2/247 |
| 2005/0015844 | A1 * | 1/2005 | Parsons | 2/94 |
| 2005/0193476 | A1 * | 9/2005 | Chinn | 2/247 |
| 2005/0235398 | A1 * | 10/2005 | Yoo | 2/247 |
| 2008/0047046 | A1 * | 2/2008 | Maier | 2/102 |
| 2008/0196140 | A1 * | 8/2008 | Mayerson et al. | 2/84 |
| 2009/0089913 | A1 * | 4/2009 | Ehrlickman | 2/83 |
| 2009/0158493 | A1 * | 6/2009 | Kim | 2/93 |
| 2009/0282600 | A1 * | 11/2009 | Robinson | 2/79 |
| 2009/0300818 | A1 * | 12/2009 | Waite et al. | 2/76 |

OTHER PUBLICATIONS

U.S. Appl. No. 29/330,602, filed Jan. 9, 2009.

U.S. Appl. No. 29/398,721, filed Aug. 3, 2011, Emrich et al.

U.S. Appl. No. 13/145,092, filed Sep. 21, 2011, Marois et al.

International Search Report for International (PCT) Patent Application No. PCT/US2010/021271, mailed Mar. 24, 2010 1 page.

International Preliminary Report on Patentability for International (PCT) Patent Application No. PCT/US2010/021271, issued Jul. 19, 2011 10 pages.

* cited by examiner

THREE-IN-TWO POCKET SYSTEM

TECHNICAL FIELD

Embodiments of the present invention relate generally to athletic jerseys, and more specifically to back pockets for cycling jerseys and jackets.

BACKGROUND

An ability to store and/or carry items on cycling jerseys and jackets provides a significant benefit. Standard jerseys having three pockets in the center (one in the center and one on each side) on the lower back of a garment help the user maintain balance. However, the size of the back of an athletic jersey is often too small to incorporate a standard three-pocket design. For example, many women's cycling jerseys are too narrow in the lower back portion to incorporate a standard three-pocket side-by-side design without causing significant imbalance. When pockets are placed further towards the sides of the jersey, the risk of an uncomfortable imbalance increases.

SUMMARY

Embodiments of the present invention include a system of three pockets on the back of a cycling jersey which looks from the back view like two pockets, but which also includes a third centered pocket.

A system of pockets for an athletic garment according to embodiments of the present invention includes a center pocket and first and second pockets each having an outer edge, an inner edge, a top edge, and a bottom edge. The top edge of each pocket is open, while the inner, outer, and bottom edges of each pocket are closed, according to such embodiments of the present invention. A vertical centerline of the athletic garment substantially aligns with a user's spine, and the first pocket is located on the athletic garment on one side of the vertical centerline, while the second pocket is located on the athletic garment on the other side of the vertical centerline. The first and second pockets are in a substantially symmetrical configuration about the vertical centerline, and the center pocket is substantially centered on the vertical centerline. The first and second pockets each at least partially overlap the center pocket, according to such embodiments of the present invention.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
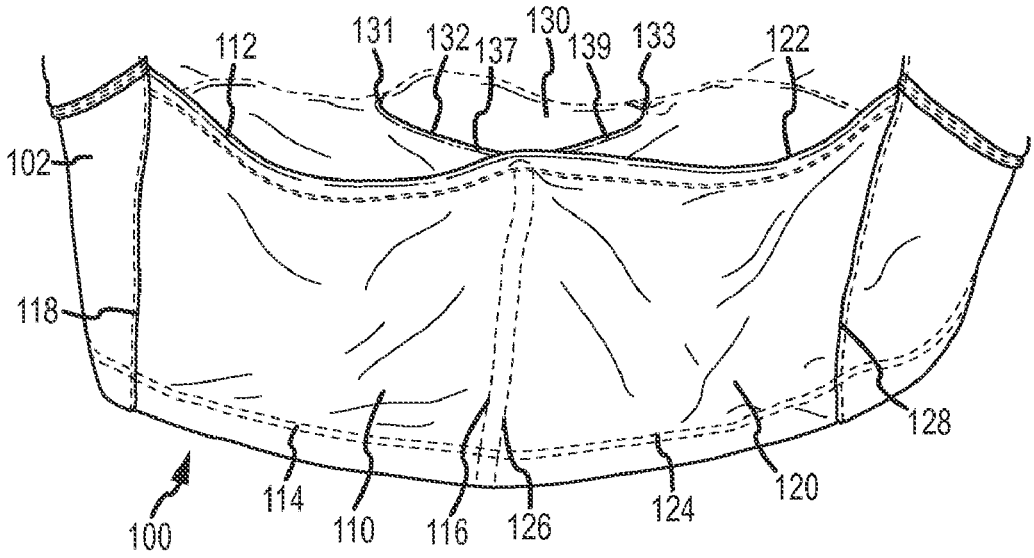
FIG. 1 illustrates a front perspective view of a pocket system according to embodiments of the present invention.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

Embodiments of the present invention include a system of three pockets on the back of a cycling jersey which looks from the back view like two pockets, but which also includes a third centered pocket.

Figure 2:
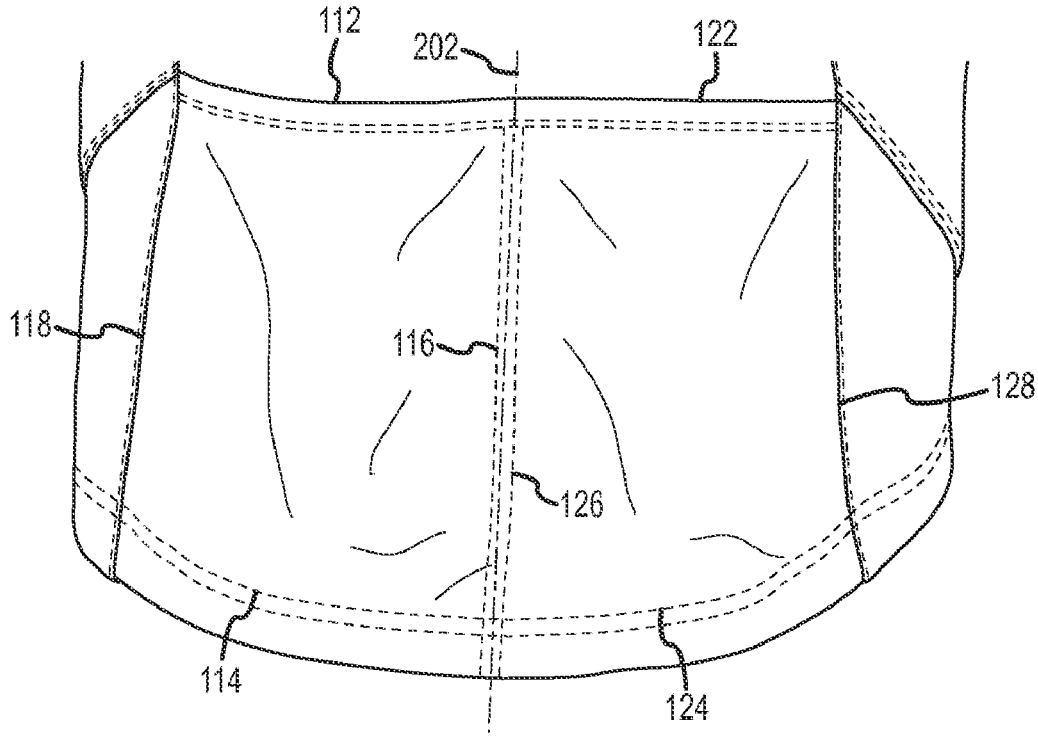
FIG. 2 illustrates a front view of the pocket system of FIG. 1, according to embodiments of the present invention.
Figure 3:
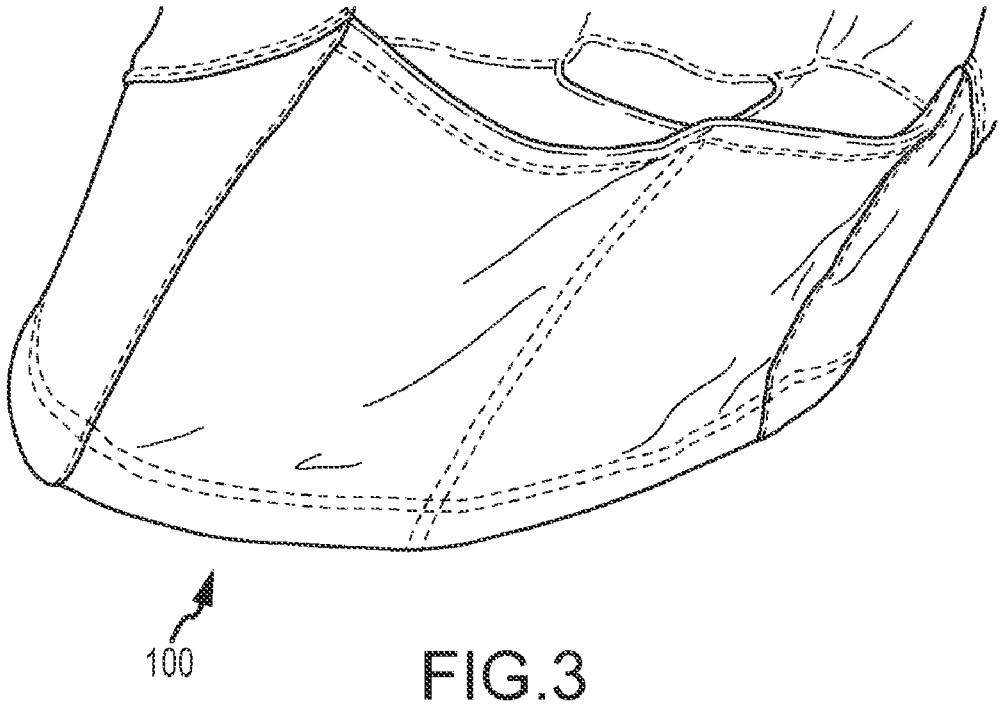
FIG. 3 illustrates a top and front left side perspective view of the pocket system of FIGS. 1 and 2, according to embodiments of the present invention.
Figure 4:
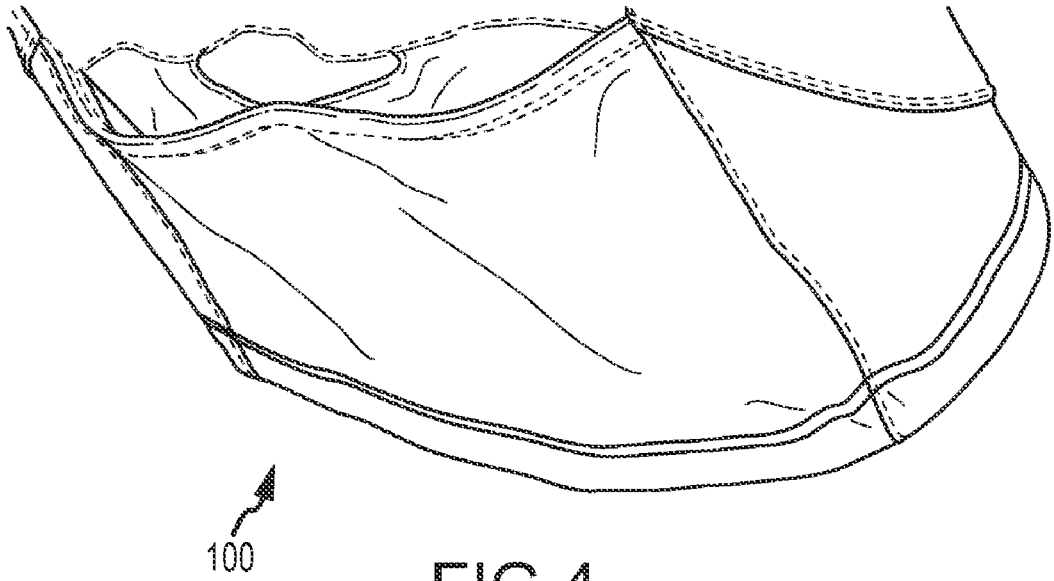
FIG. 4 illustrates a top and front right side perspective view of the pocket system of FIGS. 1-3, according to embodiments of the present invention.
Figure 5:
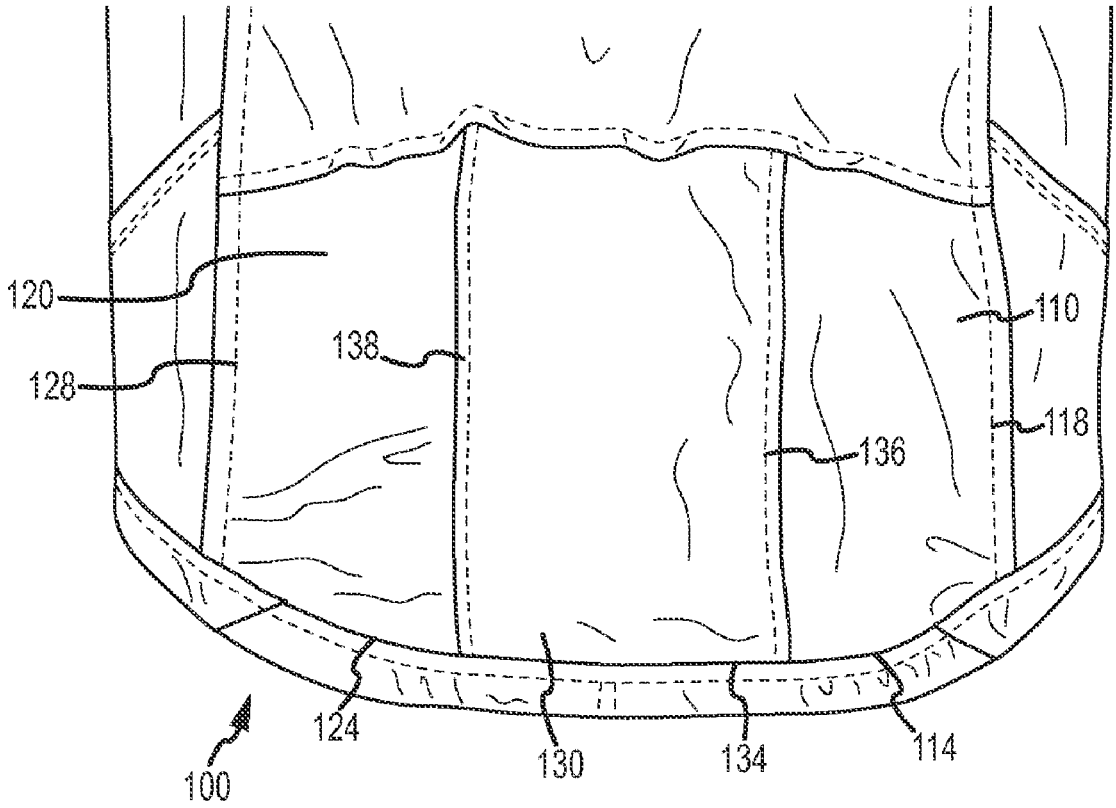
FIG. 5 illustrates an inside back view of the pocket system of FIGS. 1-4, according to embodiments of the present invention.

According to embodiments of the present invention, a pocket system 100 may be added to a garment 102, such as, for example, a cycling or running jersey. As illustrated in FIGS. 1 and 2, the pocket system 100 includes a left pocket 110, a right pocket 120, and a center pocket 130, according to embodiments of the present invention. The left pocket 110 includes a top edge 112, a bottom edge 114, an inner edge 116, and an outer edge 118, according to embodiments of the present invention. Similarly, the right pocket 120 includes a top edge 122, a bottom edge 124, an inner edge 126, and an outer edge 128, according to embodiments of the present invention. As illustrated in FIGS. 1 and 5, the center pocket 130 includes a top edge 132, a bottom edge 134, and outer edges 136, 138, according to embodiments of the present invention. According to some embodiments of the present invention, the left pocket 110 is closed along edges 114, 116, 118 and open at the top edge 112; the right pocket 120 is closed along edges 124, 126, 128 and open at the top edge 122, and center pocket 130 is closed along edges 134, 136, 138 and open at the top edge 132.

As shown in FIGS. 1 and 2, pockets 120 and 130 are adjacent to each other at a vertical centerline 202. The vertical centerline 202 is a virtual or imaginary line along the garment 102 which substantially aligns with a user's spine during use. In other words, the vertical centerline 202 extends along the horizontal midpoints of the back of the garment 102, which also correspond with the typical location of the center of a user's back (e.g. the user's spine). The athletic garment 102 need not include an actual centerline, such as, for example, a stitching pattern, which corresponds with the virtual centerline 202.

The left pocket 110 is located on the left side of the vertical centerline 202, and the right pocket 120 is located on the right side of the vertical centerline 202, according to embodiments of the present invention. The left and right pockets 110, 120 are in a substantially symmetrical configuration about the vertical centerline 202, according to embodiments of the present invention. In other words, the inner edges 116, 126 and outer edges 118, 128 of each pocket 110, 120 are substantially parallel and substantially equidistant from the vertical centerline 202. This substantially symmetrical configuration can also exist even when one or more of the pockets 110, 120 includes an irregular shape or pattern over part of the pocket 110, 120; for example, the substantially symmetrical configuration of pockets 110, 120 about the vertical centerline 202 would still exist even if a notch were cut out of the upper right hand corner of pocket 120 (but not pocket 110), or if a star pattern were cut into the center of pocket 110 (but not pocket 120), according to embodiments of the present invention.

According to some embodiments of the present invention, the center pocket 130 is substantially centered on the vertical centerline 202. In other words, the outer edges 136, 138 are substantially parallel and equidistant from the vertical centerline 202. Such a substantial centering of the center pocket 130 on the vertical centerline 202 would exist even if the center pocket 130 were of an irregular shape, or a shape that varied by height and/or width. In such cases, the center pocket 130 would be centered on the vertical centerline 202 if either the area centroid of the center pocket 130 substantially coincided with the vertical centerline 202, and/or if the left side 131 and right side 133 of the top edge 132 were substantially equidistant from the vertical centerline 202, and/or if a vertical symmetry line of the center pocket 130 substantially aligned with the vertical centerline 202, according to embodiments of the present invention.

Figure 6:
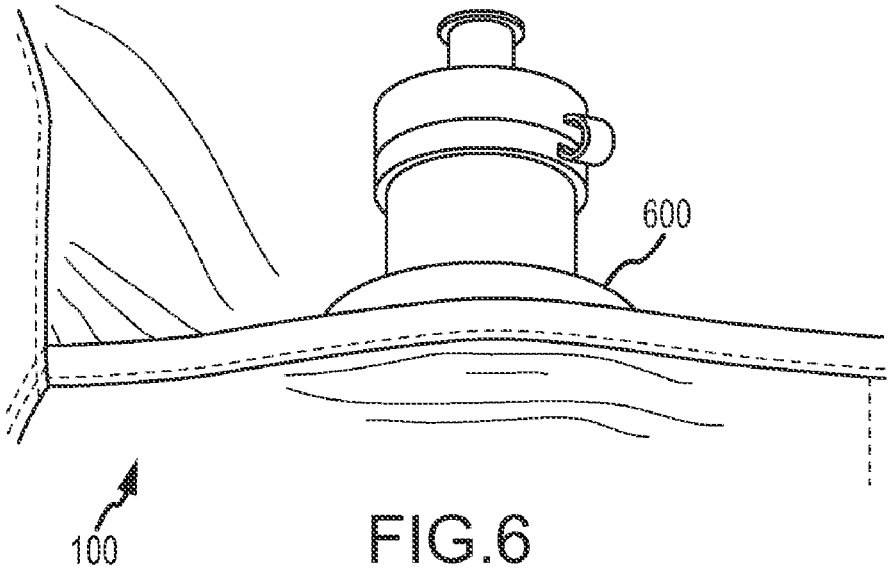
FIG. 6 illustrates a partial front view of a pocket system with a center pocket holding a water bottle, according to embodiments of the present invention.

According to some embodiments of the present invention, the left pocket 110 at least partially overlaps the center pocket 130, and the right pocket 120 at least partially overlaps the center pocket 130. In other words, when the pocket system 100 is flattened or is in use on a user's back, at least part of the left pocket 110 and right pocket 120 is over or under the center pocket 130. According to some embodiments of the present invention, the center pocket 130 is positioned to be between the user's back on one side and the pockets 110, 120 on the other side. FIG. 6 illustrates a water bottle 600 placed within a center pocket 130 of a pocket system 100, according to embodiments of the present invention. A standard-sized cycling water bottle has a diameter of approximately three inches. According to some embodiments of the present invention, the center pocket 130 is sized to snugly fit a standard-sized water bottle as depicted in FIG. 6. Although the terms "left" and "right" are used herein, one of ordinary skill in the art will appreciate that the two terms are relative to a user's vantage point, and that either pocket 110 and/or pocket 120 may be referred to as a "left" or "right" pocket.

According to some embodiments of the present invention, the bottom pocket is sewn at the hem with a single needle stitch or overlock. The top edge 132 of the center pocket 130 contains "invisible stitching" or overlock construction and can be with or without top stitches, according to embodiments of the present invention. The top edges 112, 122 of the pockets 110, 120 can be made with or without elastic in the fold hem or binding finish, according to embodiments of the present invention. The interior of the center pocket 130 is of overlock construction, and may be with or without top stitches, according to embodiments of the present invention. The garment 102 and/or the pocket system 100 may be constructed of a stretchable material, for example a knit material, or may be constructed of a non-stretchable material, for example a woven material. According to some embodiments of the present invention, the pockets 110, 120, 130 and the garment 102 are all made of the same stretchable material. According to some embodiments of the present invention, the top edge 112 forms at least a part 137 of the top edge 132, and the top edge 122 forms at least a part 139 of the top edge 132. One or more of the bottom edges 114, 124 and/or the outer edges 118, 128 is rounded, according to embodiments of the present invention. For example, the bottom edges 114, 124 may be rounded as illustrated in FIGS. 1 and 2.

Figure 7:
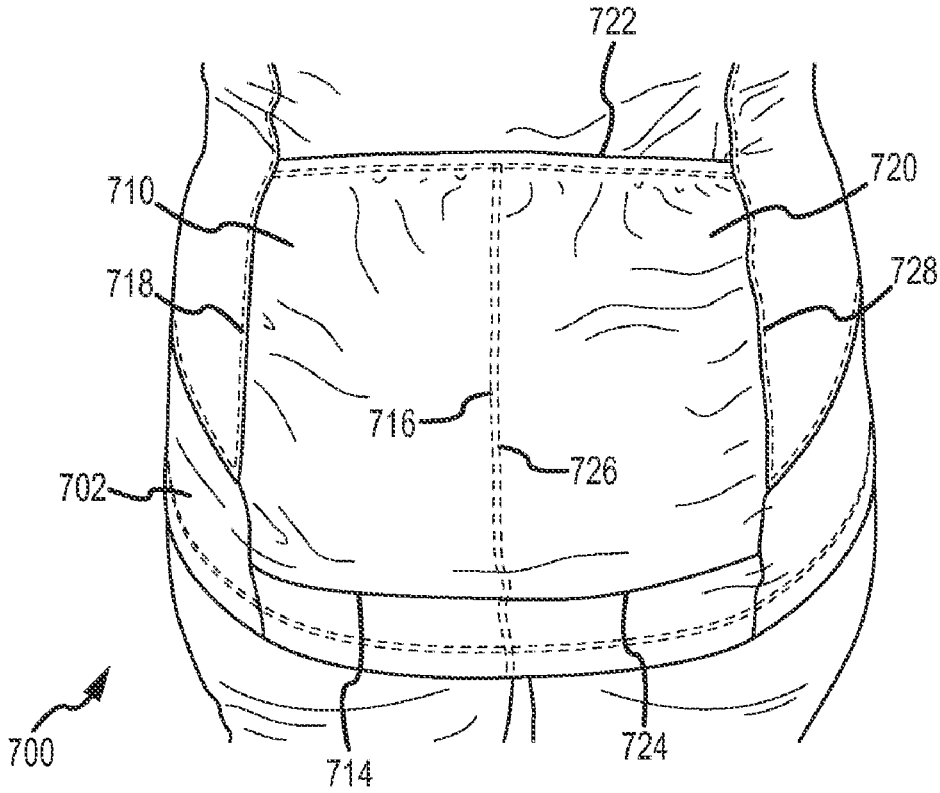
FIG. 7 illustrates a front view of a pocket system according to embodiments of the present invention.
Figure 8:
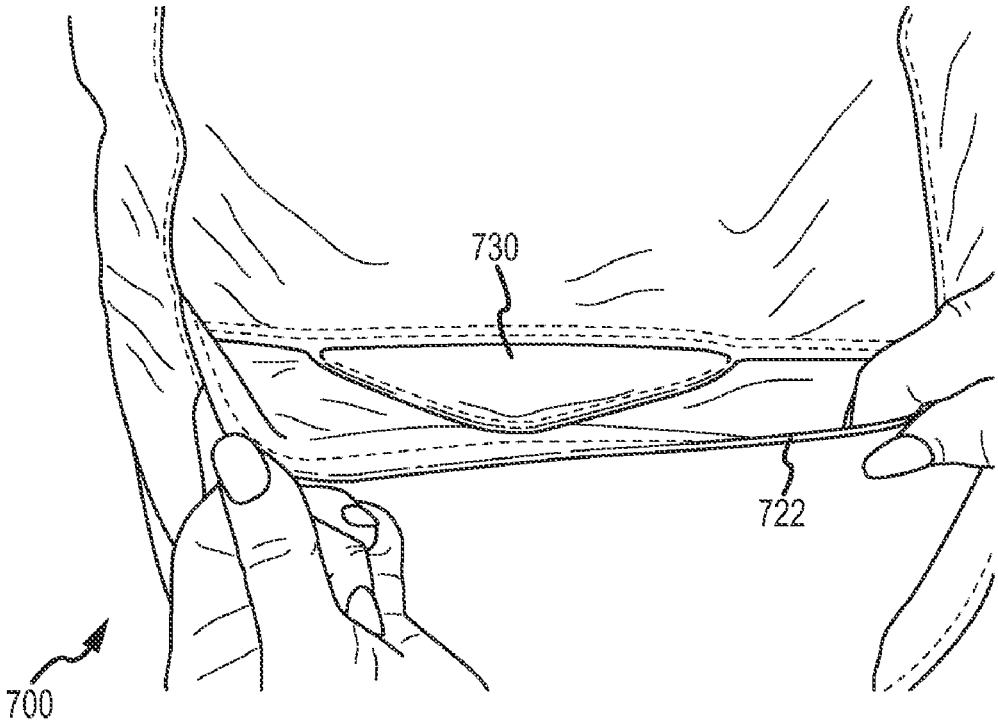
FIG. 8 illustrates an elastic top edge of two pockets of the pocket system of FIG. 7 being opened to show the inside of the two pockets and a center pocket, according to embodiments of the present invention.
Figure 9:
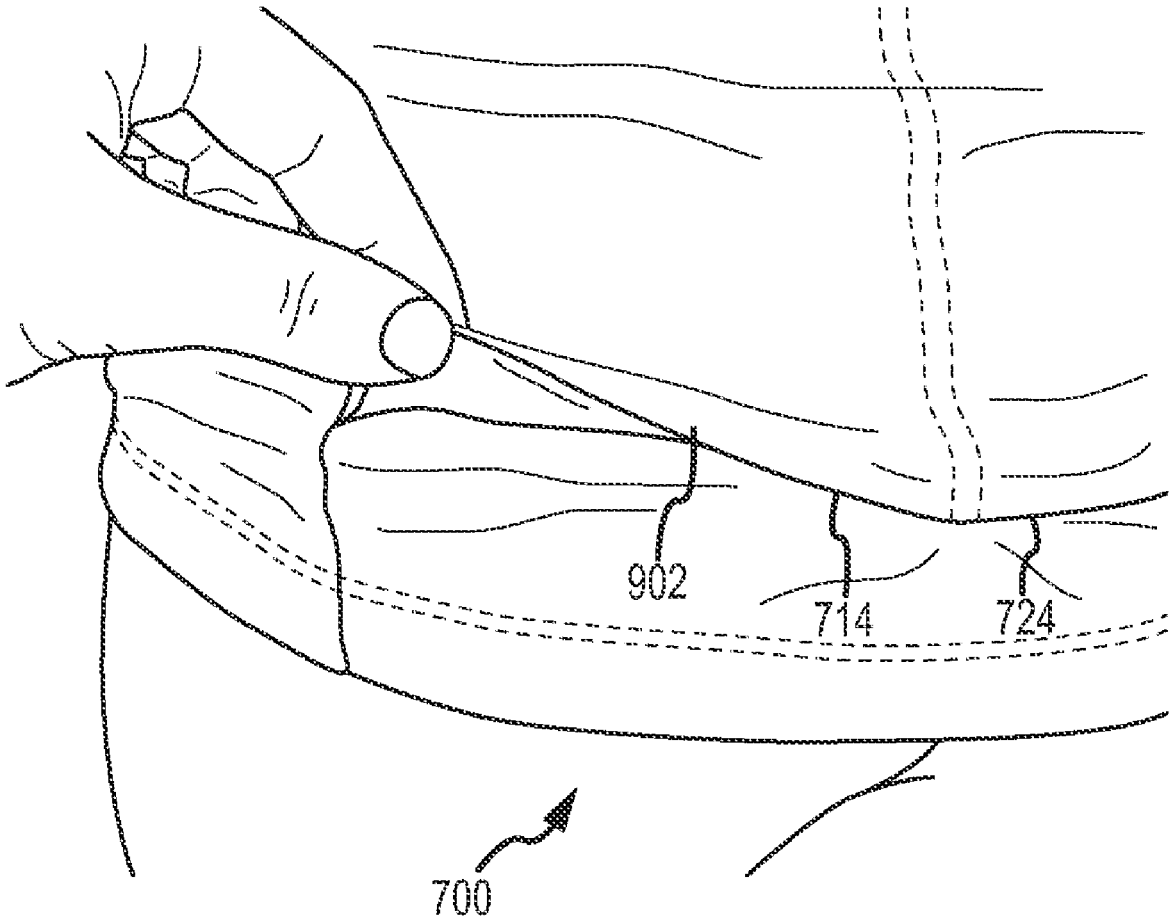
FIG. 9 illustrates a gusset at the bottom edge of the pocket system of FIGS. 7 and 8, according to embodiments of the present invention.
Figure 10:
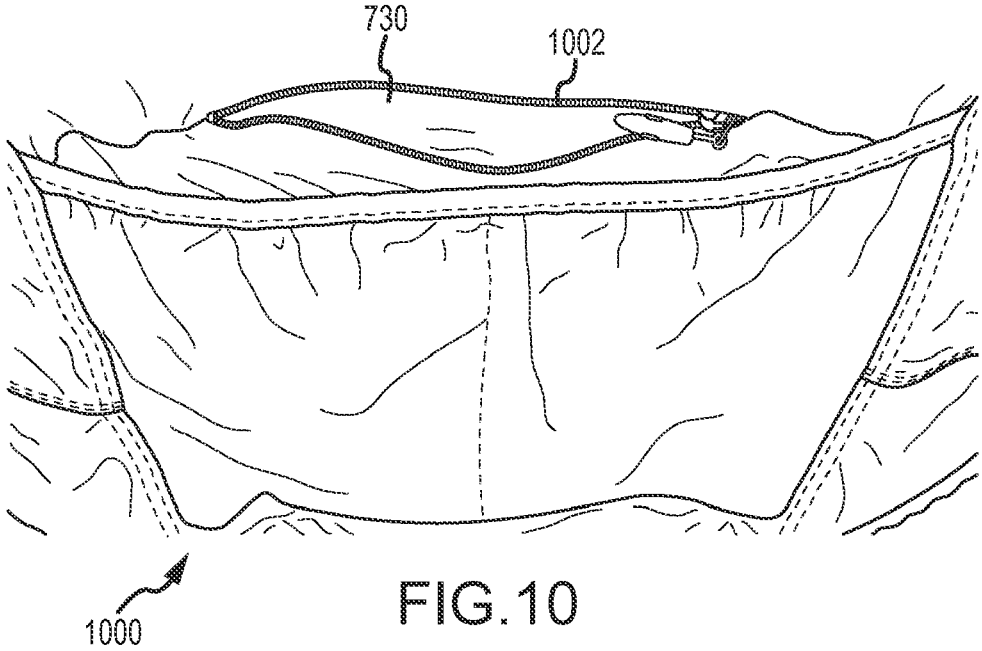
FIG. 10 illustrates a top and front perspective view of a pocket system according to embodiments of the present invention.
Figure 11:
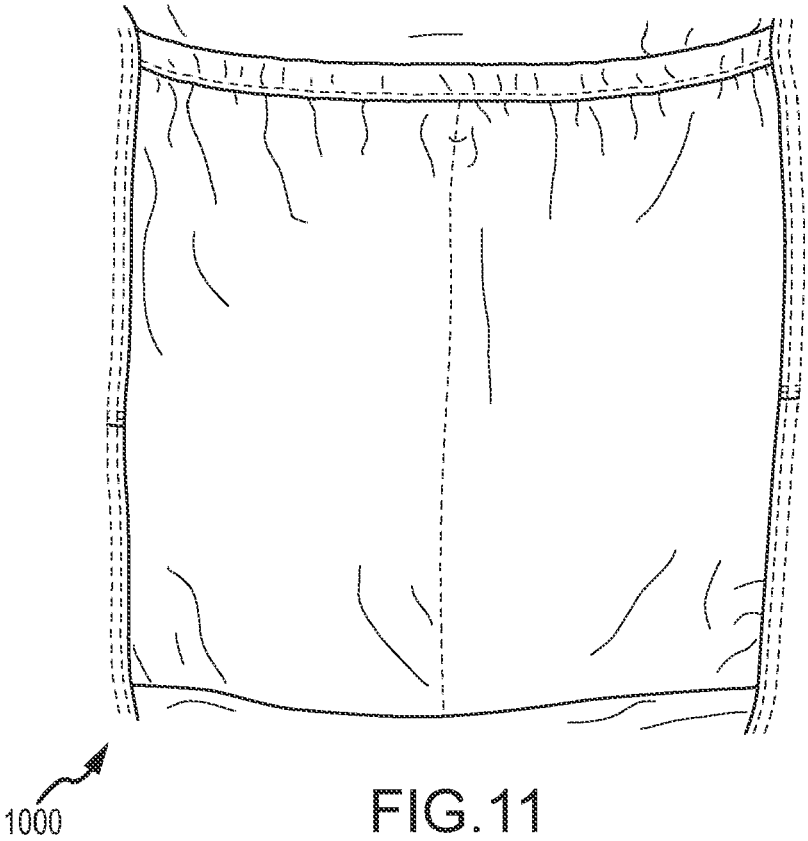
FIG. 11 illustrates a front view of the pocket system of FIG. 10, according to embodiments of the present invention.
Figure 12:
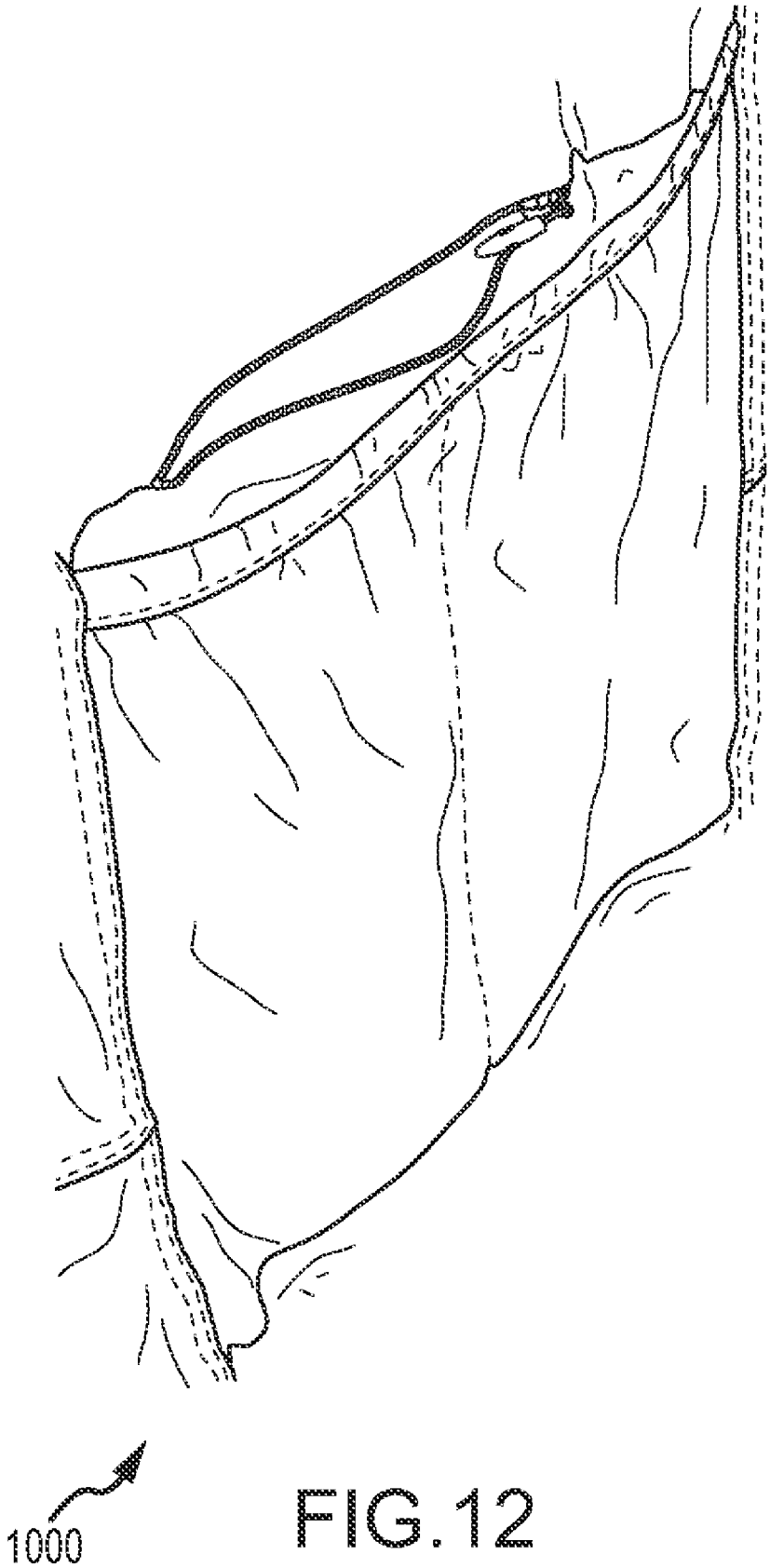
FIG. 12 illustrates a front top left perspective view of the pocket system of FIGS. 10 and 11, according to embodiments of the present invention.
Figure 13:
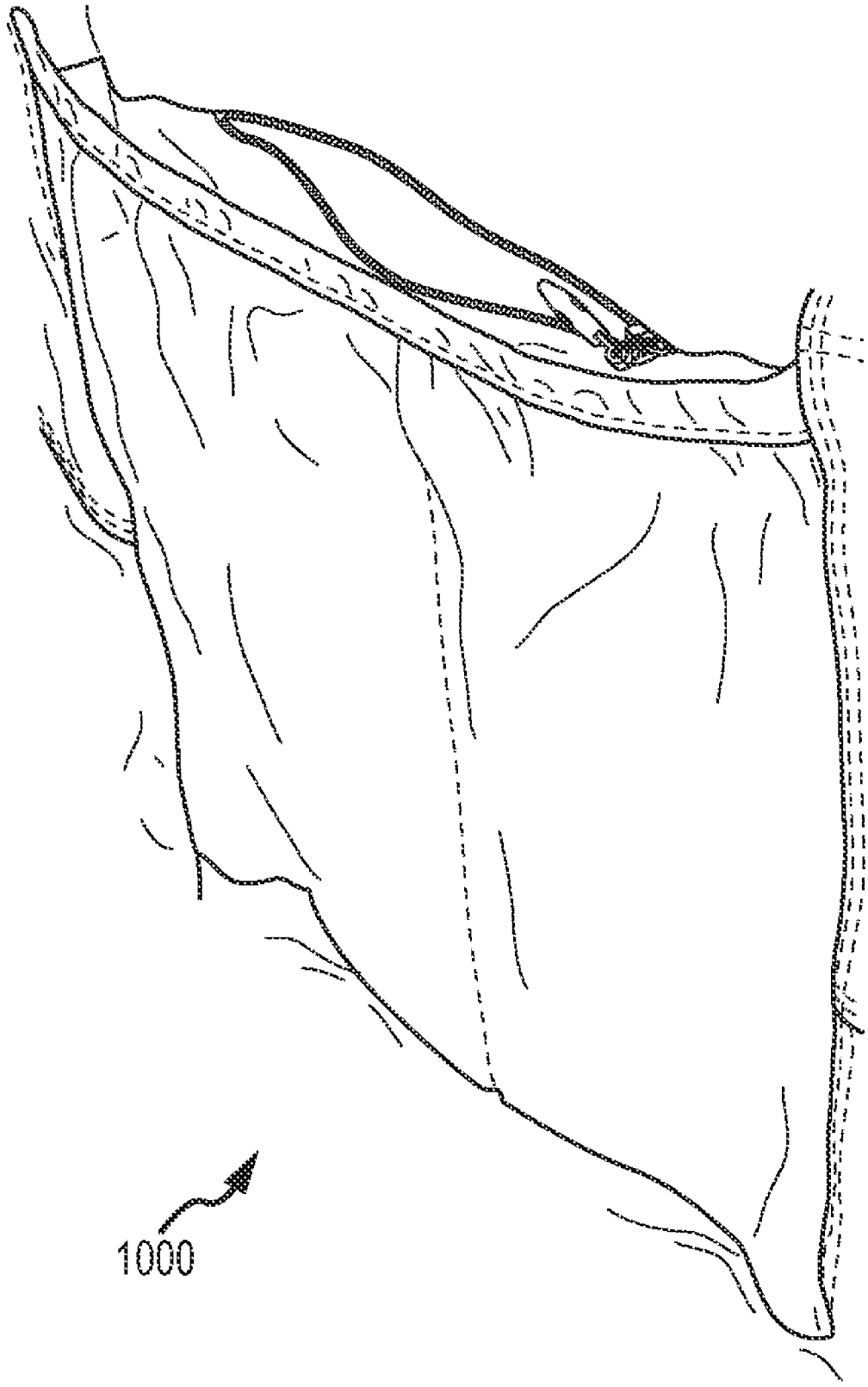
FIG. 13 illustrates a front top right perspective view of the pocket system of FIGS. 10-12, according to embodiments of the present invention.

FIGS. 7-9 illustrate an alternative pocket system 700 according to embodiments of the present invention. Pocket system 700 includes a left pocket 710 and a right pocket 720, according to embodiments of the present invention. The left and right pockets 710, 720 each include a top edge that forms a combined top edge 722 extending across both pockets, as shown, according to embodiments of the present invention. The left pocket also includes a bottom edge 714, an inner edge 716, and an outer edge 718, and the right pocket also includes a bottom edge 724, an inner edge 726, and an outer edge 728, according to embodiments of the present invention. The inner, outer, and bottom edges 714, 716, 718 are closed, as are the inner, outer, and bottom edges 724, 726, 728, while the top edge 722 is generally open, according to embodiments of the present invention.

According to embodiments of the present invention, the outer part of top edge 722 includes elastic. The elastic holds the pockets 710, 720 closed and also holds the outer part of the top edge 722 against the jersey 702 to help conceal the center pocket 730, according to embodiments of the present invention. Elastic may be applied to the top of the left pocket 710, the right pocket 720, and/or the center pocket 730, according to embodiments of the present invention. The pockets 710 and 720 of system 700 may also be in a substantially symmetrical configuration with respect to each other about the vertical centerline of the jersey 702, and the pockets 710, 720 may overlap the center pocket 730 as described with respect to system 100, according to embodiments of the present invention.

A gusset 902 may be formed and/or included along the bottom edge 714 and/or 724, according to embodiments of the present invention. The gusset 902 can be an extra piece of fabric, or an extension of the fabric out of which the pocket 710 is made, folded on itself and attached to the jersey 702 in order to expand the storage capacity of the pocket 710, according to embodiments of the present invention. As seen in FIG. 7, the gusset 902 is relatively imperceptible when the pockets 710, 720 are closed and with nothing in them, but is readily able to expand to permit the pocket to accept wider items, according to embodiments of the present invention. According to some embodiments of the present invention, a closure device, such as, for example, a zipper, is incorporated into the gusset 902 to permit access to a pocket 710, 720 through the bottom edge 714, 724 of the pocket 710, 720. According to some embodiments of the present invention, a closure device (e.g. a zipper) is incorporated along the bottom edge 714, 724 of the pocket 710, 720 without a gusset 902, to permit bottom access to the pocket 710, 720. According to yet other embodiments of the present invention, a gusset is incorporated inside of closure device along the bottom edges 714, 724, such that opening the closure device permits an opening and expansion of the gusset. According to some embodiments of the present invention, a closure device (e.g. a zipper) is incorporated into the top edge 722 of the pocket 710, 720 with or without a gusset 902 at the bottom edge, and the closure device permits top access to the pocket 710, 720, 730. According to some embodiments of the present invention, a closure device (e.g. a zipper) is incorporated into or along the top edge 722 between top edge 722 and athletic garment 702.

According to embodiments of the present invention, the pocket system 700 includes elastic along the outside top edge 722 of the pockets 710, 720 and is recessed one and a half inches from the jersey bottom hem with a gusset 902 to provide more storage. Specifically, the bottom pocket is sewn at one and a half inches from the jersey bottom hem with an invisible top stitch, according to embodiments of the present invention. Gusset 902 is also included on one or more pockets 710, 720 to provide more storage. The top of the pockets 710, 720 contains "invisible stitching" or overlock construction and can be with or without top stitches, according to embodiments of the present invention. The outer part of the top edge 722 is made with or without elastic in the fold hem or binding finish, according to embodiments of the present invention. The interior center pocket 730 is of overlock construction with or without top stitches, according to embodiments of the present invention.

Figure 14:
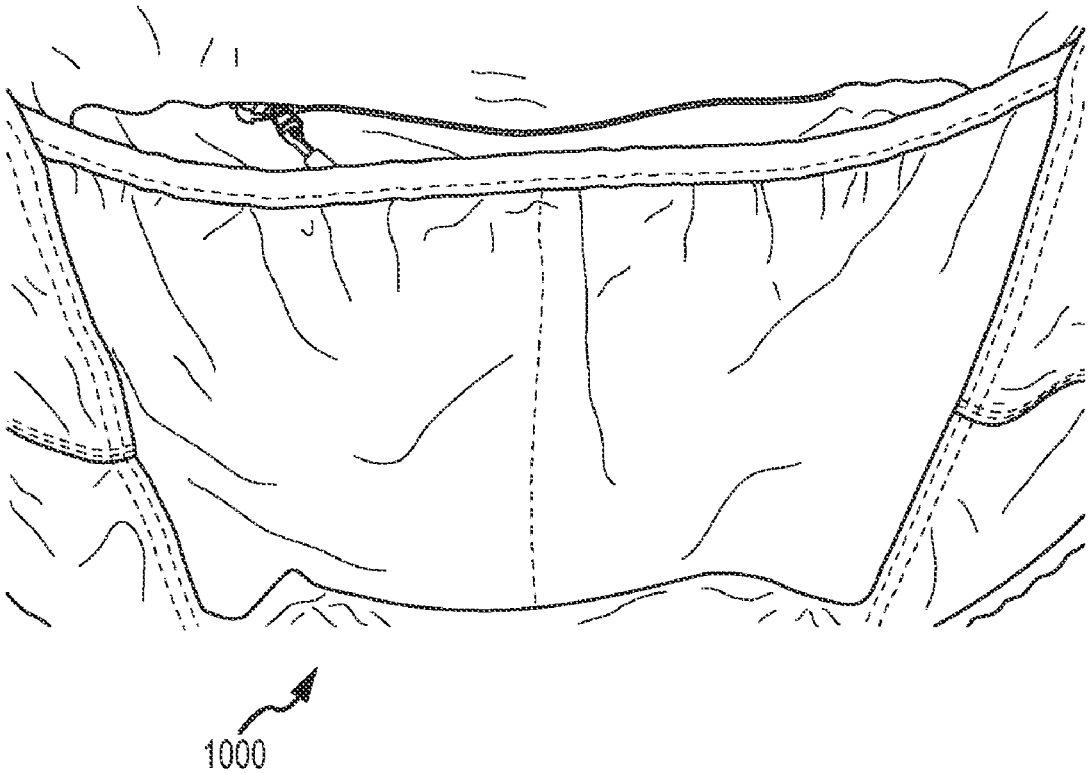
FIG. 14 illustrates a top and front perspective view of the pocket system of FIGS. 10-13 with a center pocket zipper in a closed configuration, according to embodiments of the present invention.
Figure 15:
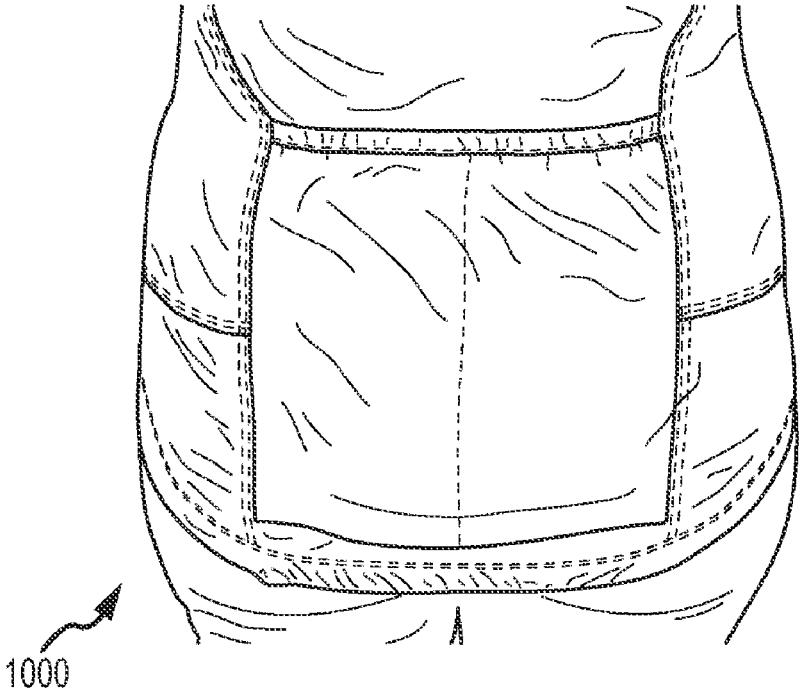
FIG. 15 illustrates a front view of a pocket system similar to the pocket system of FIGS. 10-14, according to embodiments of the present invention.
Figure 16:
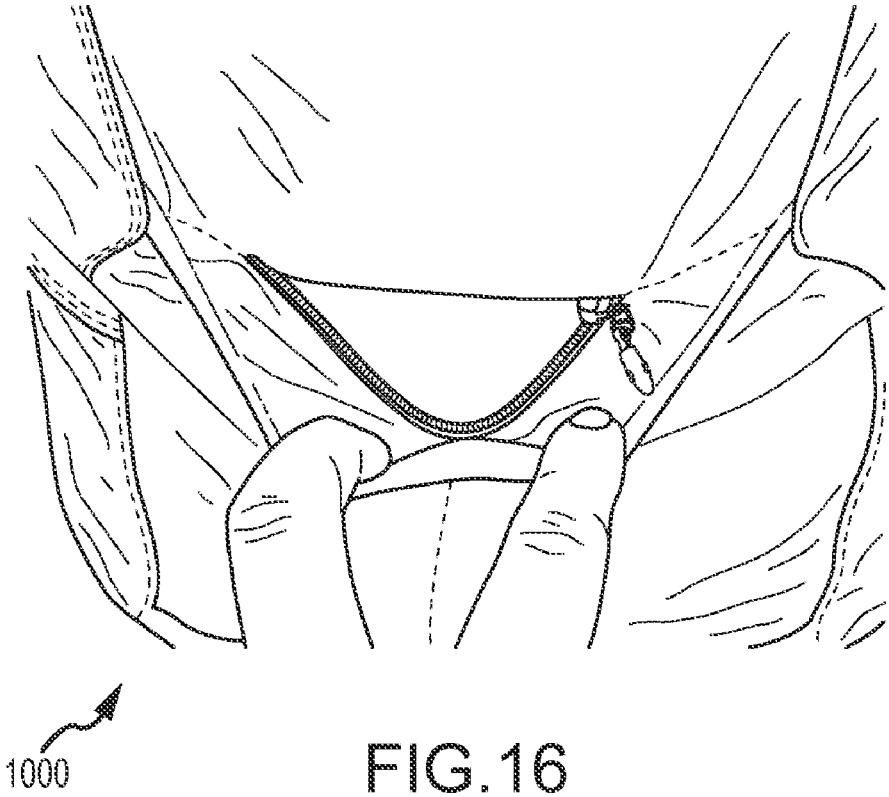
FIG. 16 illustrates a front view of the pocket system of FIG. 15, with the center pocket zipper open and the elastic pulled outward, according to embodiments of the present invention.
Figure 17:
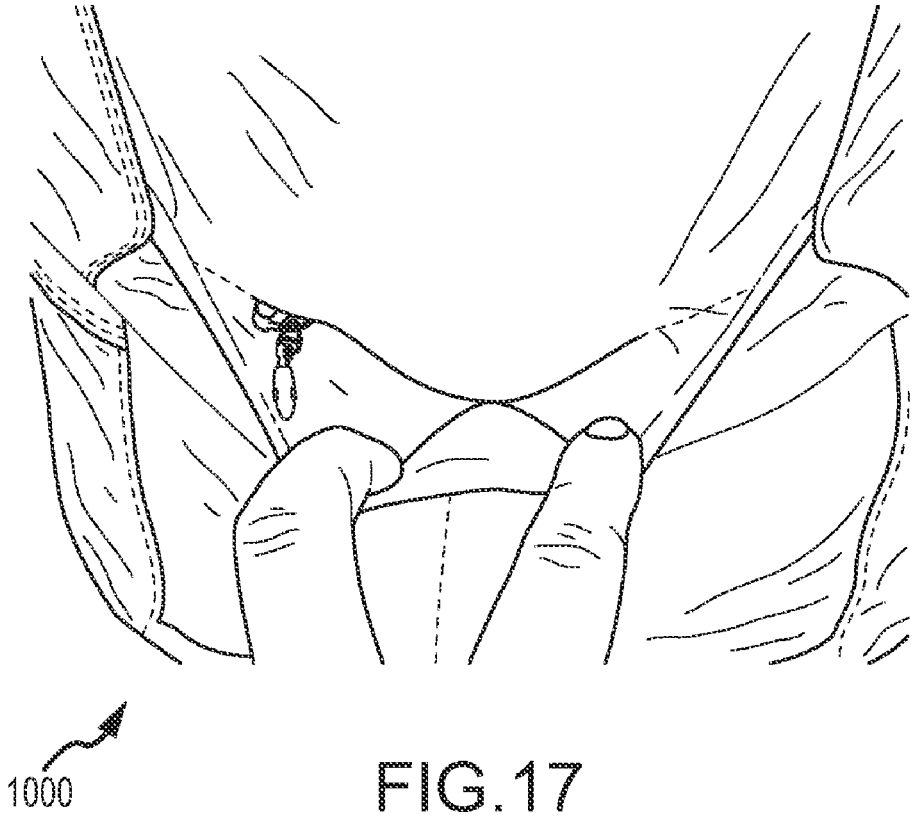
FIG. 17 illustrates a front view of the pocket system of FIGS. 15 and 16, with the center pocket zipper closed and the elastic pulled outward, according to embodiments of the present invention.
Figure 18:
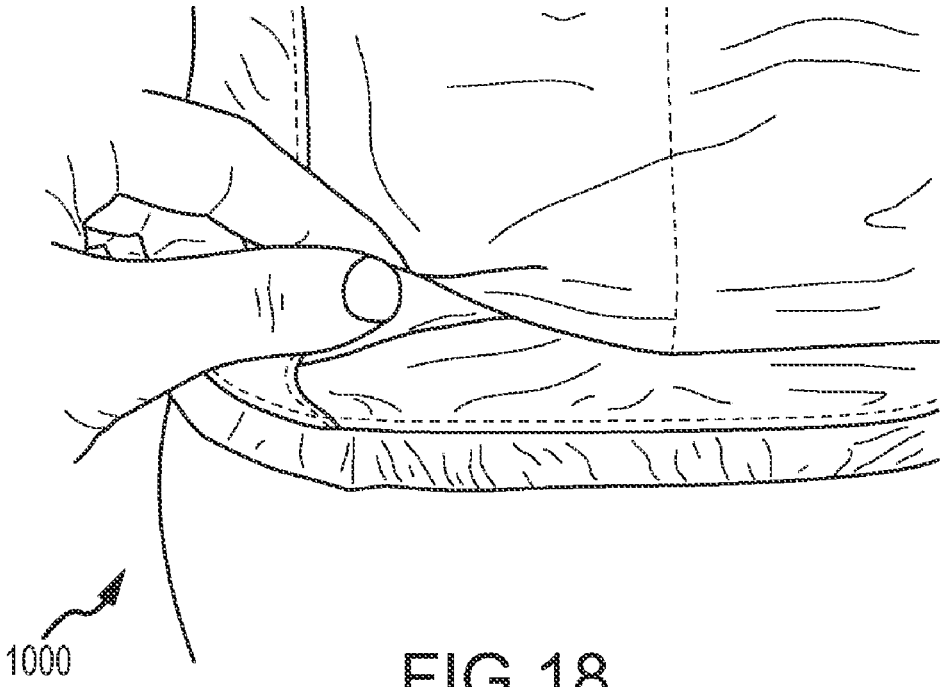
FIG. 18 illustrates a gusset at the bottom edge of the pocket system of FIGS. 15-17, according to embodiments of the present invention.

FIGS. 10-18 illustrate a pocket system 1000 similar to the pocket system 700 of FIGS. 7-9, but with a closure device 1002 across the top edge of the center pocket 730, according to embodiments of the present invention. According to some embodiments of the present invention, the closure device 1002 is a zipper. The zipper 1002 may be an invisible or a standard coil zipper, for example. According to other embodiments of the present invention, the closure device 1002 is a hook-and-loop closure device, a snap closure device, a button closure device, a Ziploc®-type closure device, and/or a slider-type closure device. FIGS. 10-13 illustrate the pocket system 1000 with the closure device 1002 open, while FIG. 14 illustrates the pocket system 1000 with the closure device 1002 closed, according to embodiments of the present invention. As illustrated in FIG. 18, the pocket system 1000 may also include a gusset along the bottom edge of the pockets as shown, according to embodiments of the present invention. According to some embodiments of the present invention, a closure device (e.g. closure device 1002) may be used with the center pocket 130 of the pocket system 100 of FIGS. 1-5.

Figure 19:
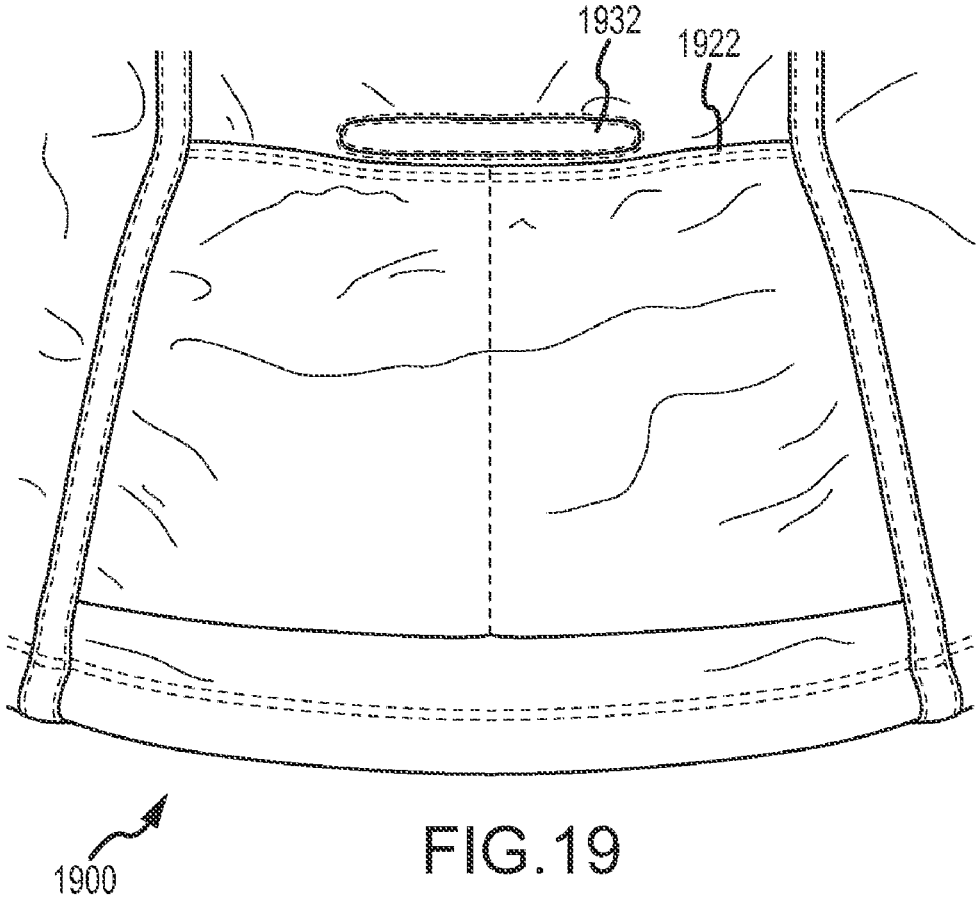
FIG. 19 illustrates a front view of an alternative pocket system according to embodiments of the present invention.
Figure 20:
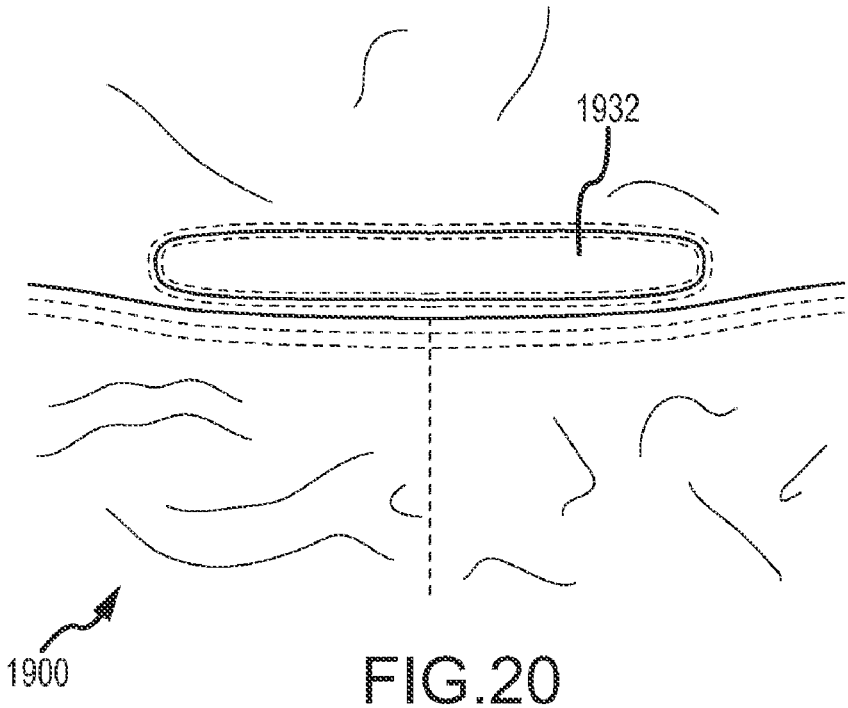
FIG. 20 illustrates an enlarged front view of a center pocket opening of the pocket system of FIG. 19, according to embodiments of the present invention.
Figure 21:
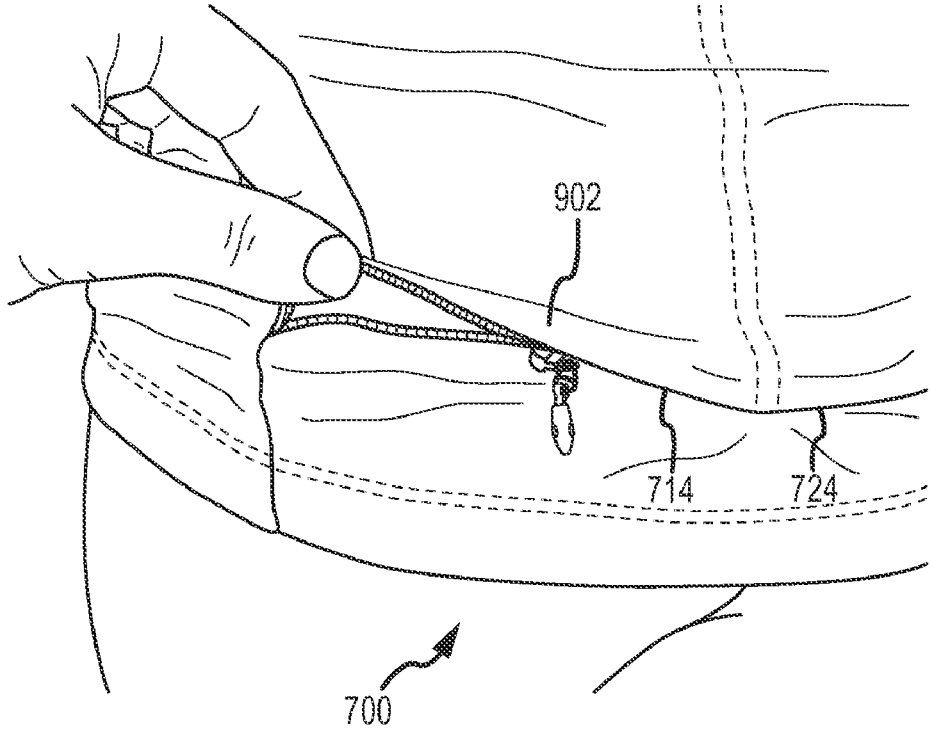
FIG. 21 illustrates an embodiment of the gusset of FIG. 9 with a zipper closure.
Figure 22:
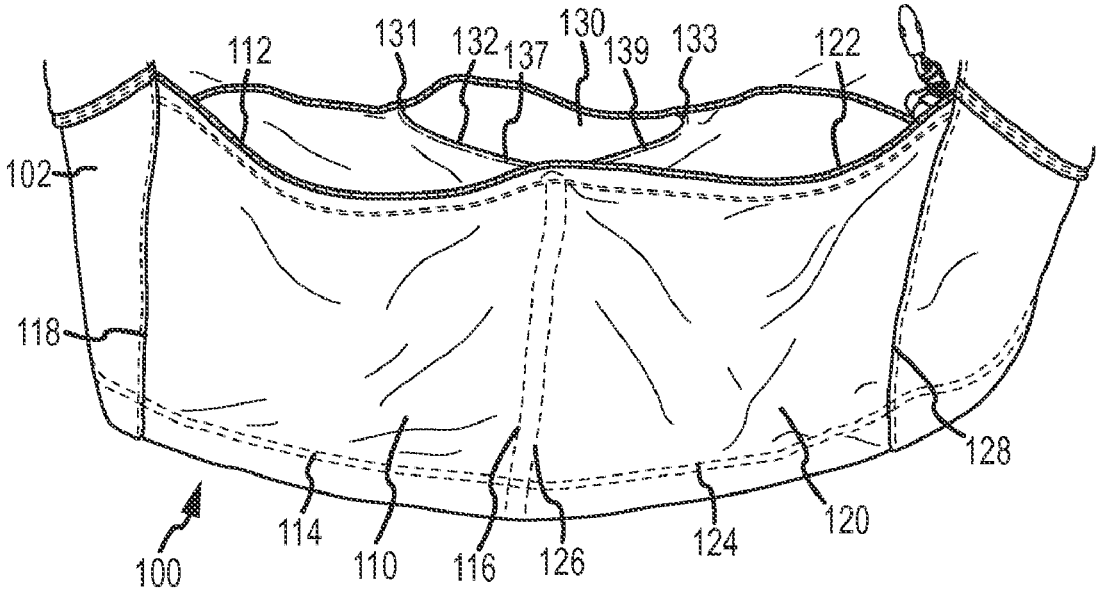
FIG. 22 illustrates an embodiment of FIG. 1 with an embodiment of a closure.

FIGS. 19 and 20 illustrate a front view of an alternative pocket system 1900 according to embodiments of the present invention. According to some embodiments of the present invention, pocket system 1900 is similar to pocket systems 700, 1000, except the top edge 1932 opening for the center pocket is positioned on the athletic garment above the top edge 1922 of the first and/or second pocket, such that it is visible even when the first and/or second pockets are closed. According to some embodiments of the present invention, the top edge 1932 includes a pocket closure device, such as, for example, a zipper. Such a pocket closure device is configured to permit opening and closure of the top of the center pocket, according to embodiments of the present invention.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

What is claimed is:

1. A system of pockets for an athletic garment, the system comprising:

a first pocket having a first outer edge, a first inner edge, a first top edge, and a first bottom edge, wherein the first pocket is closed along the first inner, outer, and bottom edges and open along the first top edge;

a second pocket having a second outer edge, a second inner edge, a second top edge, and a second bottom edge, wherein the second pocket is closed along the second inner, outer, and bottom edges and open along the first top edge, wherein a vertical centerline of the athletic garment substantially aligns with a user's spine, wherein the first pocket is located on the athletic garment on one side of the vertical centerline, wherein the second pocket is located on the athletic garment on the other side of the vertical centerline, and wherein the first and second pockets are in a substantially symmetrical configuration about the vertical centerline;

a center pocket having a third outer edge, a fourth outer edge, a third top edge, and a third bottom edge, wherein the center pocket is closed along the third bottom edge and the third and fourth outer edges and open along the third top edge, wherein the center pocket is substantially centered on the vertical centerline, wherein the first pocket at least partially overlaps the center pocket, wherein the second pocket at least partially overlaps the center pocket;

a gusset formed along the first bottom edge and the second bottom edge, the gusset configured to provide increased storage capacity within the first and second pockets; and a zipper along the gusset, the zipper configured to provide access to the first pocket along the first bottom edge and to the second pocket along the second bottom edge.

2. The system of claim 1, wherein the third top edge is positioned on the athletic garment above the first and second top edges such that the third top edge is visible even when the first and second pockets are closed, the third top edge comprising a zipper closure device.

3. A system of pockets for an athletic shirt, the system comprising:

a first pocket having a first outer edge, a first inner edge, a first top edge, and a first bottom edge, wherein the first pocket is closed along the first inner, outer, and bottom edges and open along the first top edge;

a second pocket substantially the same shape as the first pocket, the second pocket having a second outer edge, a second inner edge, a second top edge, and a second bottom edge, wherein the second pocket is closed along the second inner, outer, and bottom edges and open along the first top edge, wherein a vertical centerline of the athletic shirt, substantially aligns with a user's spine, wherein the first pocket is located on the athletic shirt on one side of the vertical centerline, wherein the second pocket is located on the athletic shirt on the other side of the vertical centerline, and wherein the first and second pockets are in a substantially symmetrical configuration about the vertical centerline; and a center pocket having a third outer edge, a fourth outer edge, a third top edge, and a third bottom edge, wherein the center pocket is closed along the third bottom edge and the third and fourth outer edges and open along the third top edge, wherein the center pocket is substantially centered on the vertical centerline, wherein the first and second pockets are adjacent to one another at the vertical centerline, wherein the first pocket at least partially overlaps the center pocket, wherein the second pocket at least partially overlaps the center pocket; wherein the first top edge forms at least a part of the third top edge, wherein the second top edge forms at least a part of the third top edge, and wherein the third top edge is positioned collinear with or beneath the first and second top edges.

4. A system of pockets for an athletic shirt, the system comprising:

a first pocket having a first outer edge, a first inner edge, a first top edge, and a first bottom edge, wherein the first pocket is closed along the first inner, outer, and bottom edges and open along the first top edge;

a second pocket having a second outer edge, a second inner edge, a second top edge, and a second bottom edge, wherein the second pocket is closed along the second inner, outer, and bottom edges and open along the first top edge, wherein a vertical centerline of the athletic shirt substantially aligns with a user's spine, wherein the first pocket is located on the athletic shirt on one side of the vertical centerline, wherein the second pocket is located on the athletic shirt on the other side of the vertical centerline, wherein the first and second pockets are adjacent to one another at the vertical centerline, and wherein the first and second pockets are in a substantially symmetrical configuration about the vertical centerline;

a center pocket having a third outer edge, a fourth outer edge, a third top edge, and a third bottom edge, wherein the center pocket is closed along the third bottom edge and the third and fourth outer edges and open along the third top edge, wherein the center pocket is substantially centered on the vertical centerline, wherein the first pocket at least partially overlaps the center pocket, wherein the second pocket at least partially overlaps the center pocket, wherein the first top edge forms at least a part of the third top edge, wherein the second top edge forms at least a part of the third top edge, and wherein the first and second top edges are arranged to overlap the third top edge.

5. The system of claim 4, wherein the first and second pockets are adjacent to one another at the vertical centerline.

6. The system of claim 4, wherein the third top edge includes a pocket closure device.

7. The system of claim 6, wherein the pocket closure device is a zipper.

8. The system of claim 4, wherein the first, second, and center pockets, when viewed from behind, have the outward appearance of two pockets.

9. The system of claim 4, wherein the third top edge is formed with overlock construction.

10. The system of claim 4, wherein the first top edge and second top edge are formed with overlock construction.

11. The system of claim 4, wherein the first top edge and the second top edge include elastic.

12. The system of claim 4, further comprising: a gusset formed along the first bottom edge and the second bottom edge, the gusset configured to provide increased storage capacity within the first and second pockets.

13. The system of claim 4, wherein the athletic shirt, the first and second pockets, and the center pocket are stretchable.

14. The system of claim 13, wherein the athletic shirt, the first and second pockets, and the center pocket are made of a single stretchable material.

15. The system of claim 4, wherein the center pocket is situated between the user's back and at least part of the first and second pockets.

16. The system of claim 4, wherein the center pocket is wide enough to accept a standard-sized cycling water bottle.

17. The system of claim 4, wherein one or more of the first bottom edge, second bottom edge, first outer edge, and second outer edge is rounded.

18. The system of claim 4, further comprising a closure device between the first and second top edges and the athletic shirt, the closure device configured to permit access to an inside of the first, second, and third pockets.

19. The system of claim 3, wherein the third top edge includes a pocket closure device.

20. The system of claim 19, wherein the pocket closure device is a zipper.

* * * * *

UNITED STATES PATENT AND TRADEMARK OFFICE

CERTIFICATE OF CORRECTION

PATENT NO. : 8,312,568 B2
APPLICATION NO. : 12/355638
DATED : November 20, 2012
INVENTOR(S) : Caroline Marois and Sue McKinney It is certified that error appears in the above-identified patent and that said Letters Patent is hereby corrected as shown below:

In the Claims:

Claim 1, column 6, line 37, “first” should read --second--.

Claim 3, column 7, line 10, “first” should read --second--.

Claim 4, column 7, line 41, “first” should read --second--.

Signed and Sealed this
Thirtieth Day of April, 2013

Teresa Stanek Rea
*Acting Director of the United States Patent and Trademark Office*